US005511266A

United States Patent [19]

Dinis

[11] Patent Number: 5,511,266

[45] Date of Patent: Apr. 30, 1996

[54] CONTINUOUS INCREMENTALLY ERECTING VIADUCT CONSTRUCTION SYSTEM

[75] Inventor: Antonio A. Dinis, La Jolla, Calif.

[73] Assignee: Bridgesys Corporation, San Diego, Calif.

[21] Appl. No.: 349,875

[22] Filed: Dec. 6, 1994

[51] Int. Cl.[6] ..... E01D 21/00

[52] U.S. Cl. ..... 14/2.5; 14/75; 14/77.1

[58] Field of Search ..... 14/2.4, 2.5, 23, 14/77.1, 75

[56] References Cited

U.S. PATENT DOCUMENTS

| | | | |
|---|---|---|---|
| 3,027,633 | 4/1962 | Murphy | 14/77.1 X |
| 4,497,153 | 2/1985 | Muller | 14/77.1 X |
| 4,646,379 | 3/1987 | Muller | 14/23 |

FOREIGN PATENT DOCUMENTS

| | | | |
|---|---|---|---|
| 357317 | 10/1972 | U.S.S.R. | 14/77.1 |
| 950847 | 8/1982 | U.S.S.R. | 14/77.1 |

*Primary Examiner*—Ramon S. Britts
*Assistant Examiner*—James A. Lisehora
*Attorney, Agent, or Firm*—Baker, Maxham, Jester & Meador

[57] ABSTRACT

A precast segmental viaduct construction system, comprises an elongated erection and assembly vehicle for spanning between at least two viaduct piers and for moving between successive piers, the vehicle having a top deck, an elongated central longitudinal beam having a down facing elongated planar bottom support surface, a pair of elongated trusses secured to and inclined outward from said beam, and a pair of elongated longitudinal planar top support surfaces extending along opposite side edges of said top deck, a plurality of jacks spaced along the vehicle for cooperatively engaging piers on which the vehicle is supported for positioning the vehicle relative to piers on which it is supported, and a support assembly for supporting the vehicle on a pier, the support assembly having jacks for selectively elevating and lowering the vehicle.

17 Claims, 13 Drawing Sheets

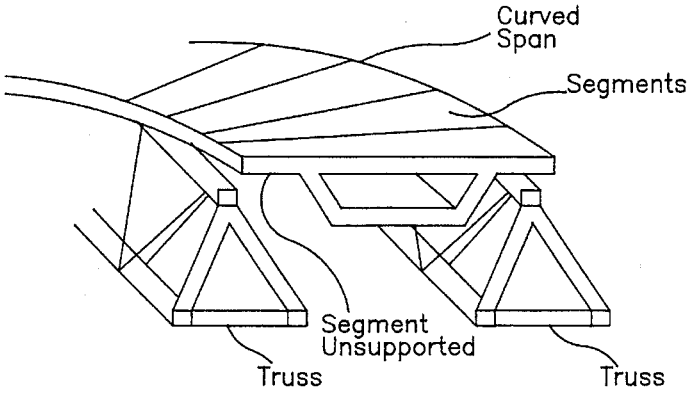
FIG. 6
(PRIOR ART)
FIG. 7
(PRIOR ART)
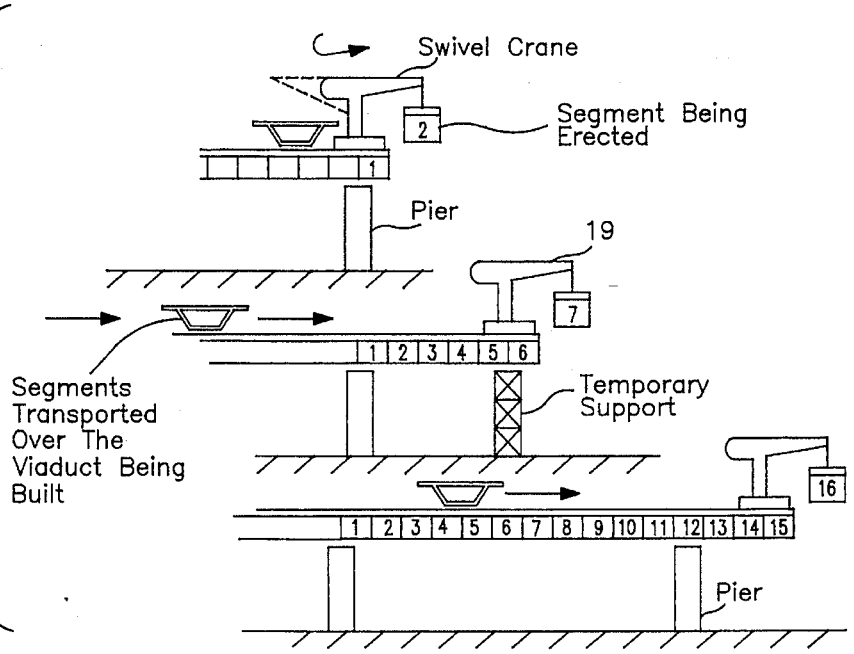

CONTINUOUS INCREMENTALLY ERECTING VIADUCT CONSTRUCTION SYSTEM

BACKGROUND OF THE INVENTION

The present invention relates generally to the design and construction of precast segmental viaducts, and more particularly, to the erection and assembly systems and equipment of bridge segments during the construction of the viaducts of spans of up to 60M, with continuous or simple supported spans, with straight or moderately curved alignments. Precast segmental viaducts are commonly built using the following three methods:

The first method is the Span-by-Span Construction method illustrated in FIGS. 1–6. According to this technique, precast concrete segments 10 having match-cast joints, are assembled end to end along one span of the viaduct over two consecutive piers A, B and B, C, and are placed temporarily on steel trusses 11 and 12 that are supported by steel brackets 13 fixed on the piers.

Once the segments are adjusted over the trusses, post-tensioned cables are inserted into the segments and stressed. The span is then self-supported. Trusses are lowered and launched to the next span and the same construction cycle takes place again. Segments are transported either using the already built viaduct, or from the roads underneath the viaduct in construction. Cranes 17 (FIG. 1) 18 (FIG. 5) or gantries are used for the erection of segments, working at ground level, or over the already built span. The trusses are generally twin parallel trusses that extend between piers and on both sides of the span. The pier brackets are bolted to the piers or the loads are transferred directly to the pier footings. This method was applied exclusively for simple supported spans of straight viaducts for spans not exceeding 40M (120 FT). The segments are usually single box girders with wings on both sides and the trusses are placed under such wings. FIG. 3 illustrates boxguiders 14 supported on a pair of steel beams 15 and 16. These conditions considerably reduce the area of application of this method. For the safety of people and vehicles moving close to the construction area, a system relying on temporary supports is not recommended.

The second method is the Progressive Placing Construction method illustrated in FIG. 5, 7*a, b* and *c*. When spans are larger than 40M (120 FT) and/or the viaducts are curved, and/or the box girders have reduced wings, the Span-by-Span method is not usually applicable. In these cases, the progressive placing construction has been used in precast segmental viaduct construction. According to this method, the segments are placed and assembled one by one, from one end of the viaduct to the other, in cantilever construction, self-supported. The segments are usually transported using the viaduct being constructed. A swivel crane 19 placed over the last segment assembled takes the new segment from behind and places it in front. Cantilever type cables are then inserted and stressed. The swivel crane is moved to the top of the newly assembled segment and the cycle repeats itself until the cantilever reaches either the next pier, which may be the actual pier, or a temporary pier. This method allows to span up to 70M (210 FT) and can be used in curved viaducts with continuous spans, but has some disadvantages. In particular, it requires the swivel crane to be moved after erection of each segment; it cannot be applied when the viaduct is too narrow; it is very slow; and it requires additional post-tensioning.

The third method is the Balanced Cantilever method of construction illustrated in FIG. 8 which is usually used for viaducts with spans from 70M (210 FT) to 150M (450 FT). It was previously used with cast-in-situ segments and is now more commonly applied on precast segmental viaducts of large spans. As illustrated FIG. 8 the principle of this method that can be used on viaducts with curved alignments and different types and shapes of box girders an overhead gentry 20 supported on a pier is used to move the segments from the completed section to build out from each pier.

The prior art methods suffer from different disadvantages. The Span-by-Span construction requires that trusses be supported by pier brackets outside the pier which are difficult to install and remove, and as previously noted, can interfere with traffic clearances and security. Furthermore, it requires the movement of cranes at ground level and has limitations concerning curvature of viaducts, is not applicable for continuous structures, wide single box girders, bridge deck sections U shaped, or generally, girders without wings.

The trusses used in prior art methods cannot take any torsional moments as they are simply placed over the pier brackets. In general, in the Span-by-Span method and the Progressive Placing method, the gantries or cranes are to be moved, independently of the trusses or other temporary supports, after assembly of each segment, which is a critical operation in the path of construction. In view of the foregoing, there is an evident need for an improved viaduct construction system that overcomes the deficiencies of prior art methods.

More particularly there is needed a construction method for precast segmental, match-cast joints, that is fast, structurally stable, does not require temporary supports, pier brackets or trusses that can interfere with vehicle traffic underneath the viaduct being built. A method that can accept curved alignments, be self-launched with integrated erection and assembly equipment, and that can be used with different widths of segments, multibox sections, or U shaped sections allowing the construction by either simple supported span-by-span or with the continuity of the structure over the piers.

SUMMARY OF THE INVENTION

In accordance with a primary aspect of the present invention, a precast segmental viaduct construction system, comprises an elongated erection and assembly vehicle for spanning between at least two viaduct piers and for moving between successive piers, said vehicle having a top deck, an elongated central longitudinal beam having a down facing elongated planar bottom support surface, a pair of elongated trusses secured to and inclined outward from said beam, and a pair of elongated longitudinal planar top support surfaces extending along opposite side edges of said top deck, a plurality of jacks spaced along said vehicle for cooperatively engaging piers on which said vehicle is supported for positioning said vehicle relative to piers on which it is supported, and a support assembly for supporting said vehicle on a pier, said support assembly having jacks for selectively elevating and lowering the vehicle.

In accordance with another aspect of the present invention a method for constructing a precast segmental viaduct comprising the steps of constructing a first viaduct pier to support the rear end of a span to be constructed, said viaduct pier having a "Y" shape, constructing a second viaduct pier to support a front end of a span to be constructed, said viaduct pier having a "Y" shape, mounting first and second vehicle support means on said respective first and second piers for supporting an erection and assembly vehicle, providing an elongated erection and assembly vehicle for spanning between at least two viaduct piers and for moving between successive piers, said vehicle having a top deck, an elongated central longitudinal beam having a down facing elongated planar bottom support surface, a pair of elongated trusses secured to and inclined outward from said beam, and a pair of elongated longitudinal planar top support surfaces extending along opposite side edges of said top deck positioning the longitudinal erection and assembly vehicle that passes through said first and second piers, with vertical and horizontal jacks integrated in the vehicle and in its supports, mounting said vehicle between said first and second piers, blocking the vehicle against the arms of the said first and second pier, adjusting, if required, the camber and the torsional rigidity with internal post-tensioning, using the swivel crane fixed over the nose of the vehicle to lift up, rotate and place, sequentially, the segments of the span being assembled, once the segments are released by the swivel crane, each segment is pushed or pulled to its final position in the span, levelled and adjusted against the previous segment, after assembling all segments of one span, the post-tensioning cables are placed and stressed and the span becomes self-supported, the vehicle is then lowered and pushed or pulled to the next span, with the nose and the tail assuring the stability of the vehicle that remains always supported by 2 piers.

BRIEF DESCRIPTION OF THE DRAWINGS

The above and other objects and advantages of the present invention will become apparent from the following description when read in conjunction with the accompanying drawings wherein:

FIG. 6 illustrates the problem of using the prior art for curved spans.

FIG. 7 is an elevation view of the prior art of Progressive Placing Construction method.

DETAILED DESCRIPTION OF THE PREFERRED EMBODIMENTS

Figure 1:
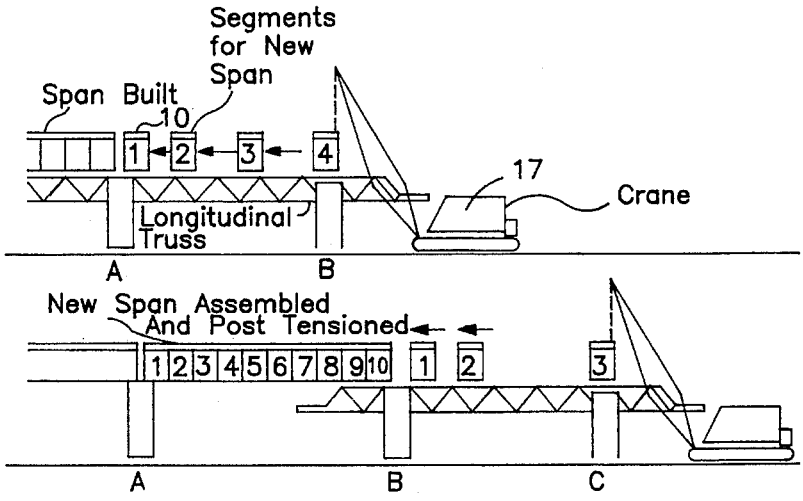
FIG. 1 (PRIOR ART)
FIG. 1 is an elevation view of the prior art of Span-by-Span Construction.
Figure 2:
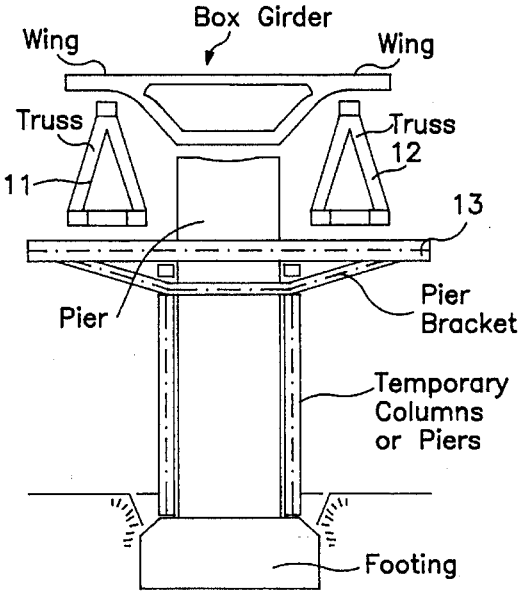
FIG. 2 (PRIOR ART)
FIG. 2 is a cross section of the viaduct with the prior art system of two parallel trusses supported by pier brackets fixed to the pier, in the case of a box girder with wings.
Figure 3:
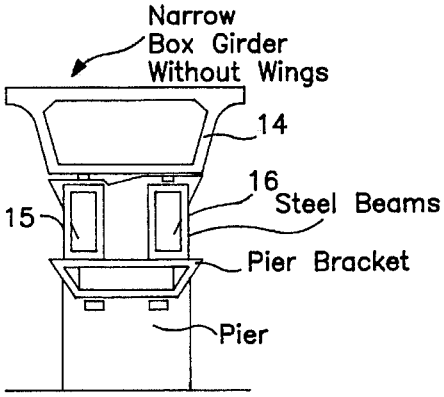
FIG. 3 (PRIOR ART)
FIG. 3 is a cross section of the viaduct with the prior art Span-By-Span method adapted for a box without wings.
Figure 4:
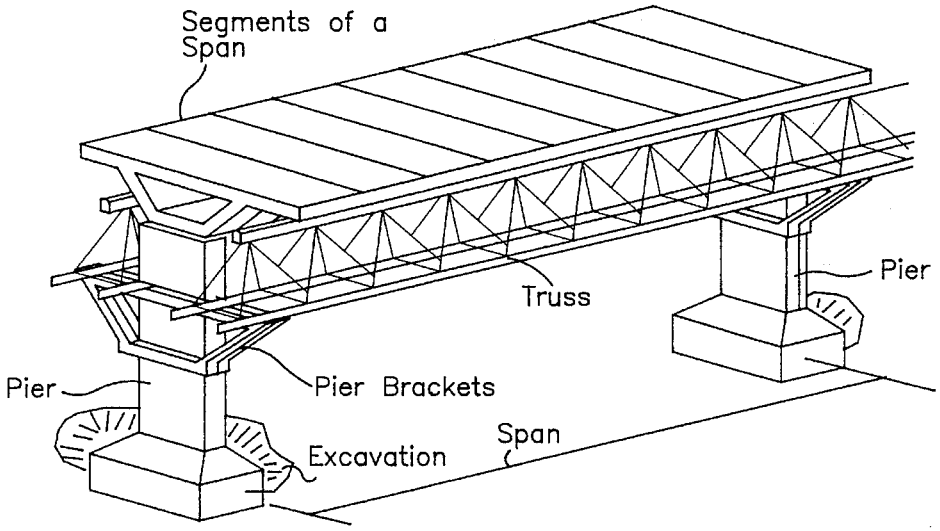
FIG. 4 (PRIOR ART)
FIG. 4 is a perspective view of the prior art viaduct construction system of FIG. 1.
Figure 5:
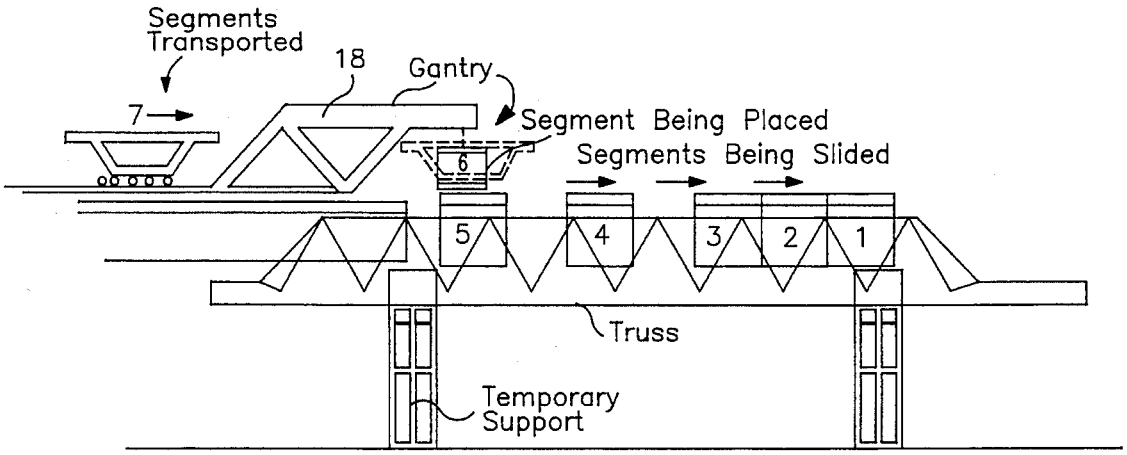
FIG. 5 (PRIOR ART)
FIG. 5 is the schematic representation of the erection and assembly system of FIG. 1.
Figure 8:
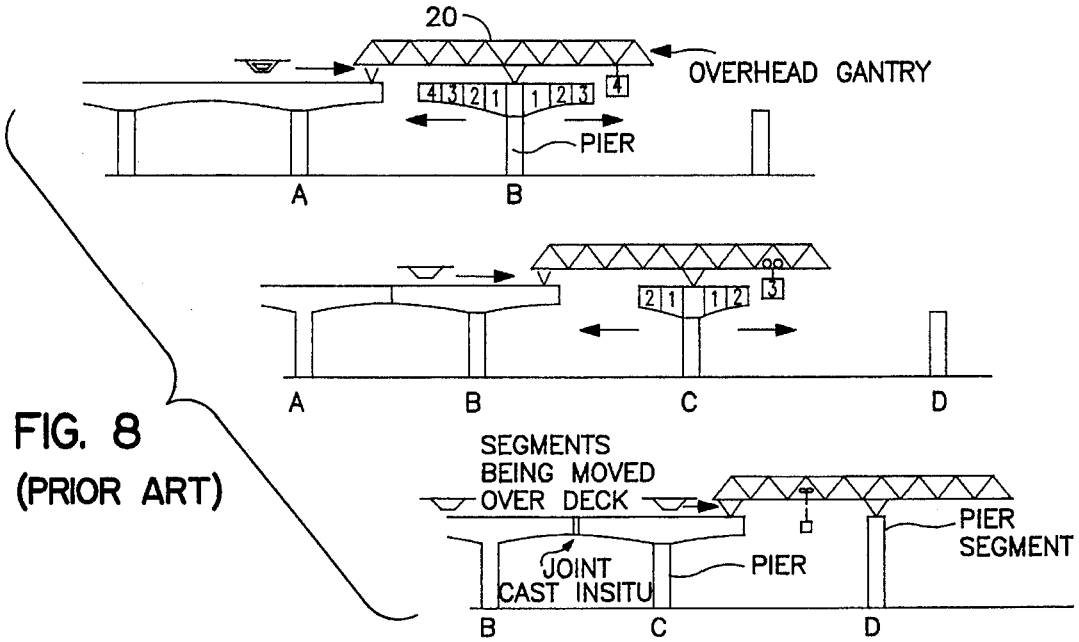
FIG. 8 (PRIOR ART)
FIG. 8 is an elevation view of the prior art of Balanced Cantilever Construction method.
Figure 9:
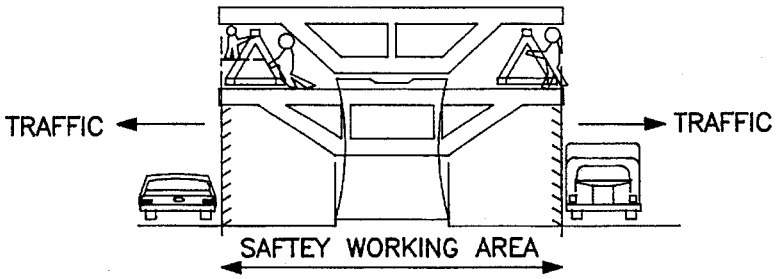
FIG. 9 (PRIOR ART)
FIG. 9 illustrates the safety working area required for the prior art Span-by-Span method underneath.
Figure 10:
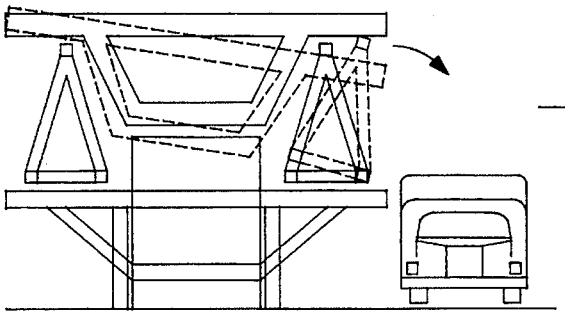
FIG. 10 (PRIOR ART)
FIG. 10 illustrates the problem of the stability of prior art parallel trusses used in the Span-by-Span system.
Figure 11:
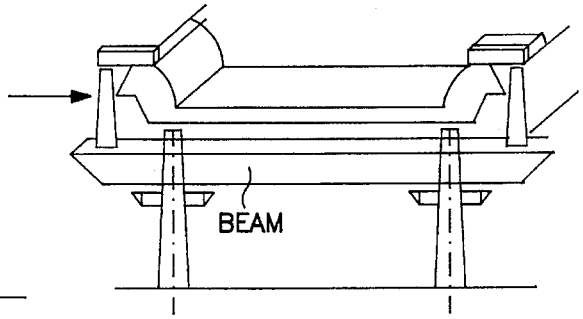
FIG. 11 (PRIOR ART)
FIG. 11 illustrates the adaptation of the prior art Span-by-Span in a U-shaped girder for precast segmental viaducts.
Figure 12:
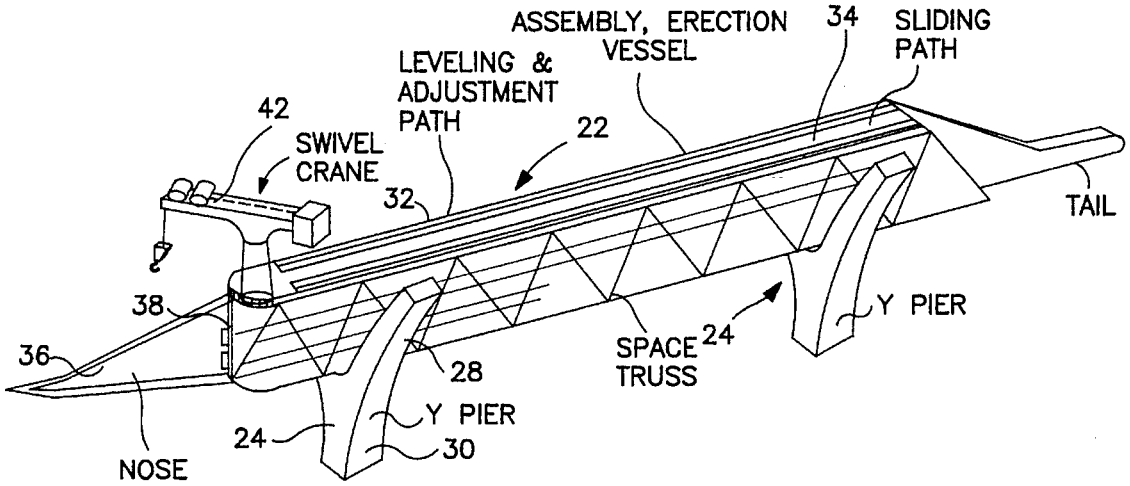
FIG. 12 is a perspective view of a preferred embodiment of the present invention with the vehicle for erection and assembly of viaducts in operative position on a pair of spaced piers.

Referring to FIG. 12 of the drawing a preferred embodiment of the apparatus of the present invention designated generally by the numeral 22 is illustrated in position to carry out the construction in accordance with the method of the invention. The present invention was devised primarily for erecting viaduct structures which are generally designed with "Y" shaped piers in order to support, between pairs of piers, the longitudinal erection and assembly apparatus which will hereinafter be termed a vehicle. The vehicle is elongated to span at least two piers and has a generally V or trapezoid transverse cross section to fit within the upturned legs of the piers. The pier 24 includes two arms 26 and 28 that are inclined and that are connected over a vertical column 30 that is built on normal foundations. The vehicle 22 is mounted or supported between the two arms of the "Y" piers and generally is constructed of a triangular steel space truss with preferably a central spine that supports the weight of the segments. The vehicle has a top deck with at least a pair of elongated top support surfaces 32 and 34 extending along the side edges of the top deck. The vehicle is also preferably provided with an elongated nose section 36 hinged at 38 for pivoting about a vertical axis. A tail section 40 is hinged for pivoting about a vertical axis at the tail end of the vehicle. The vehicle body includes two outwardly inclined trusses that give the vehicle the torsional stability and allow the adjustment to the exact geometry of the segments constituting the span.

Figure 13:
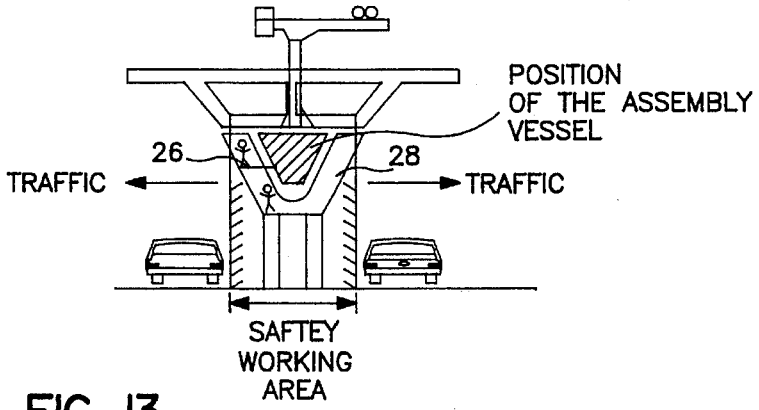
FIG. 13 is an end view of the embodiment of FIG. 12 illustrating the safety working area required by the invention.
Figure 14:
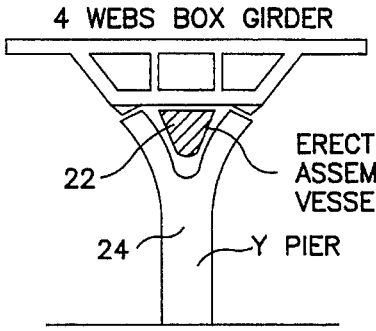
FIGS. 14, 15, 16 are like end views like FIG. 13 that illustrate applications of the invention for different types of viaduct girders.
Figure 15:
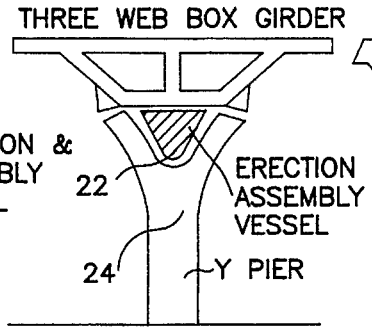
Figure 16:
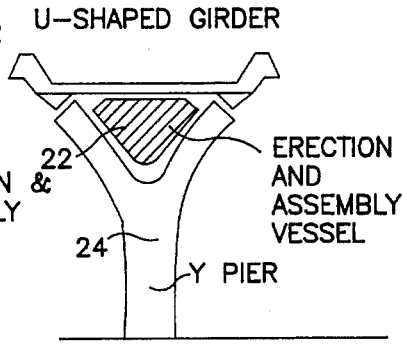

The vehicle rests between the vertical legs of the piers and assemble the viaduct girders as shown in FIGS. 13–16. A swivel crane 42 is mounted on the top deck, preferably at one end and lifts the girders onto the deck. The assembly vehicle can handle girders of three or four webs or U-shaped girders. This system allows space for street or surface traffic as shown in FIG. 13.

When the girder has two vertical webs at the edges with U shaped sections or for wider boxes with two vertical webs and two inclined webs, the two inclined trusses may be advantageously replaced by two spines giving to the vehicle a triangular cross section.

Figure 17:
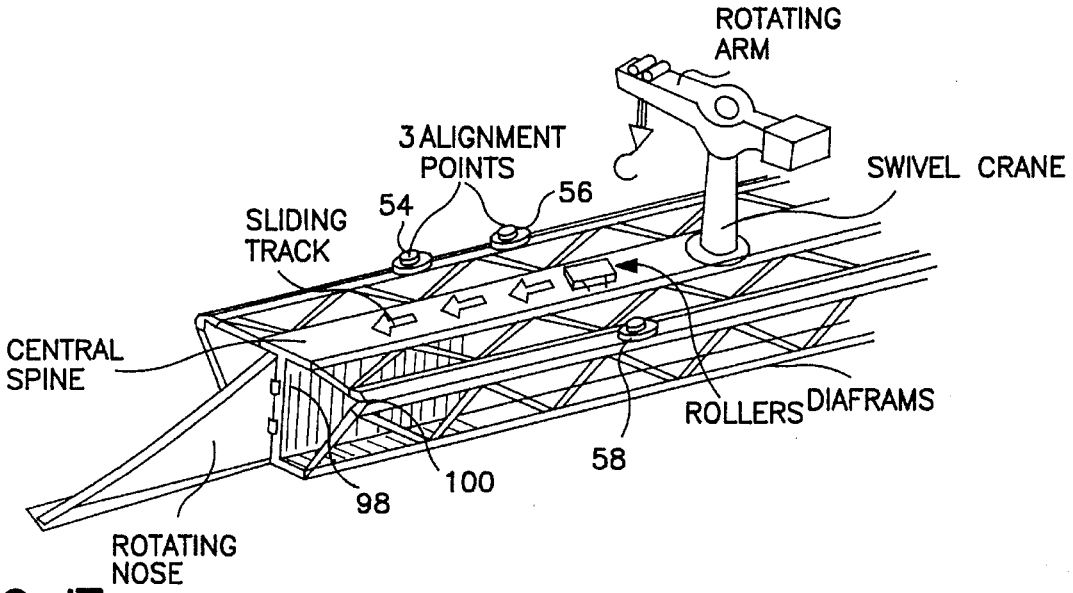
FIG. 17 is a partial detailed perspective view of a typical assembly and erection vehicle of FIG. 12.
Figure 18:
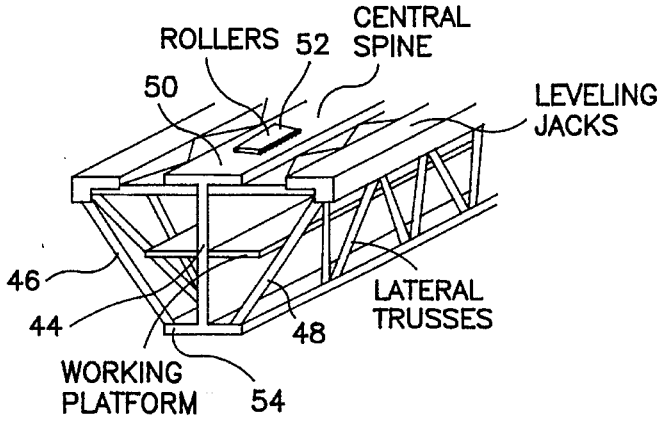
FIG. 18 is a detailed perspective end view of the embodiment of FIG. 12.

The viaduct piers are usually built of reinforced concrete but may also be built in precast segmental match-cast units, assembled vertically. The longitudinal assembly vehicle has appropriately a triangular or a trapezoidal cross section so as to fit inside the arms of the piers and below the girders. The preferred form of construction of the vehicle is as illustrated in FIGS. 17–19 with a vertical spine and lateral trusses generally fabricated in steel. The vertical spine is a plain I-section steel girder 44 or a box girder and the trusses 46 and 48 are space trusses fabricated with laminated steel sections. The trusses are inclined and have upper beams forming longitudinal planar support surfaces. Both trusses are connected to the spine with steel trusses at the top and bottom of the flanges to constitute a rigid structure that will work as a tubular space truss between the two adjacent piers. The central I beam has an upper flange 50 providing and elongated central planar support surface to support rollers or dollies 52 for supporting the girders for movement into place.

The top of the spine or I beam has a smooth surface to allow the sliding of the segments from the front end to the backside of the vehicle. The bottom of the I beam spine also has an elongated smooth planar surface 54 to slide over the jacking roller support assemblies placed between the arms at the bottom during the self-launching of the vehicle to the next span. Segments will be moved with winches or with hydraulic jacks integrated in the vehicle structure. The top of the inclined trusses is used as the adjusting lines of each segment individually, and will have 3 jacks for each segment, two on one side, and one on the other side and vice-versa in the adjacent segment. This system will allow 3 points levelling of each segment to the exact span geometry in the space.

Inside the vehicle, unbonded deviated post-tensioning cables will be fixed to the central spine and/or to the inclined trusses or inclined spines, so to be able to introduce post-tension forces that may reduce or cancel the vehicle deflections during erection.

The vehicle, once positioned between the pier arms, will be blocked against these arms by applying hydraulic jacking forces between the vehicle and the pier arms, in designated locations thus giving complete stability to the system during the erection and assembly cycle. When the viaduct has curved spans, the vehicle may not remain in the central line of the piers and the horizontal blocking jacks may push the vehicle sideways so to reduce to a minimum the eccentricity of the segments in relation to the center line of the vehicle. The horizontal blocking allows the vehicle to take current torsional moments of the curved spans common in roadway or railway viaducts.

Further to this passive torsional resistance, the vehicle can create active pretorsional moments that will be created during erection of the curved spans. This is obtained by stressing unsymmetrically the cables integrated to the spines and trusses and/or by applying at the piers different forces and pre-torsion the vehicle sections as required by the specific curved span.

The vehicle is self-launched, once the assembly of segments is completed. This self-launching operation, monitored hydraulically from a central board, will allow the vehicle to lower and release itself from the precast concrete span assembled. The jacks, placed at the bottom of the arms of the piers, will push the vehicle forward counteracting against the piers. Once the nose of the vehicle starts being supported by the following pier, its tail will progressively pass through the rear pier of the span assembled. This determines the total length of the vehicle, including nose and tail, which is generally twice the larger span.

Figure 19A:
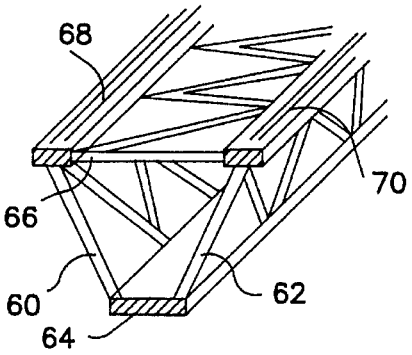
FIG. 19*a* is a view like FIG. 18 of an alternative embodiment.
Figure 19B:
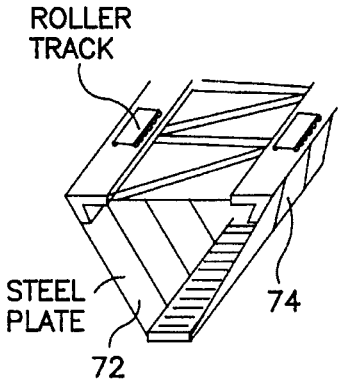
FIG. 19*b* is a view like FIG. 18 of another alternative embodiment.

The upper deck also has alignment and leveling jacks 54, 56 and 58 for aligning and leveling the girders. Other forms of construction may be as shown in FIG. 19*a*, wherein the body of the vehicle is constructed a pair of inclined trusses 60 and 62 with a central bottom beam 64 and top truss 66. The top of the side trusses have beams 68 and 70 providing planar support surfaces. A variation, as shown in FIG. 19*b*, has side steel plates 72 and 74 instead of trusses.

Figure 20:
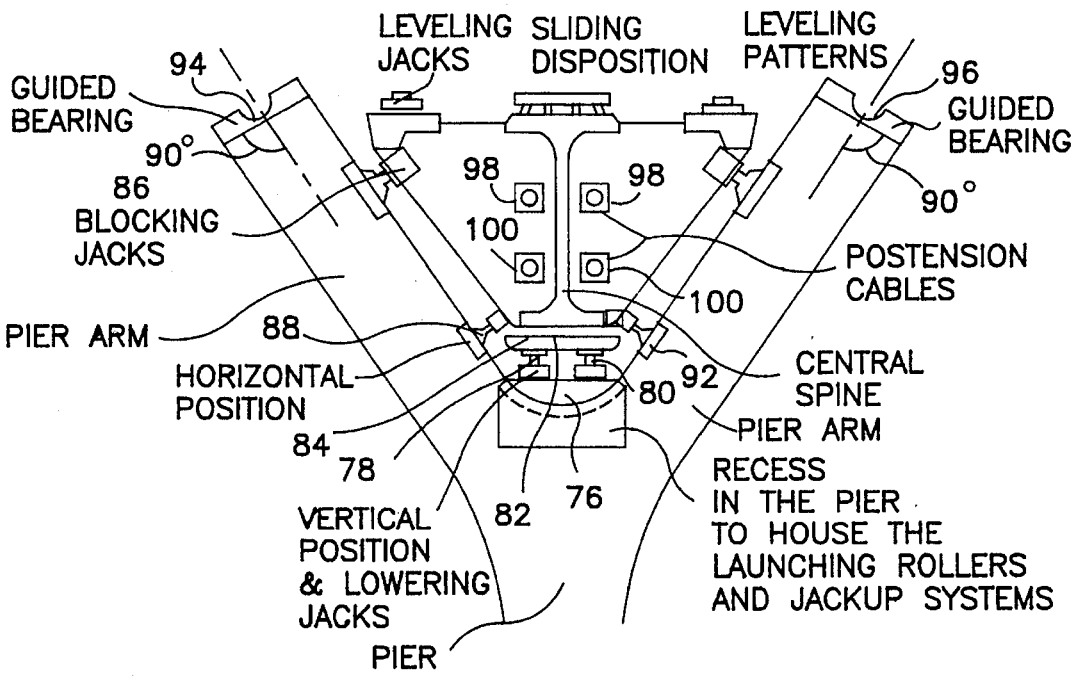
FIG. 20 is a detailed end view of the embodiment of FIG. 12 illustrating details of the supporting assembly and jack system.
Figure 21:
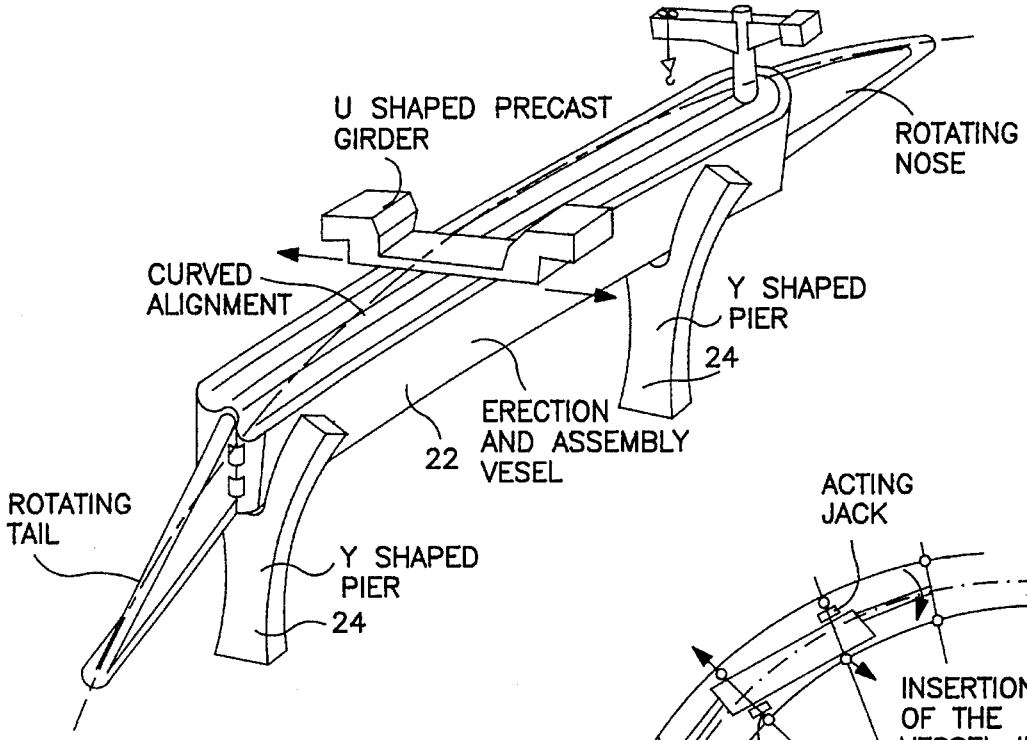
FIG. 21 is a perspective view of the invention illustrating the assembling of U-sections of a curved span.
Figure 22:
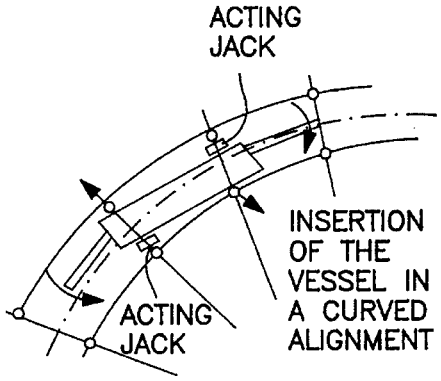
FIG. 22 is a top plan view of the vehicle an the pivoting nose and tail in a curved span.
Figure 23:
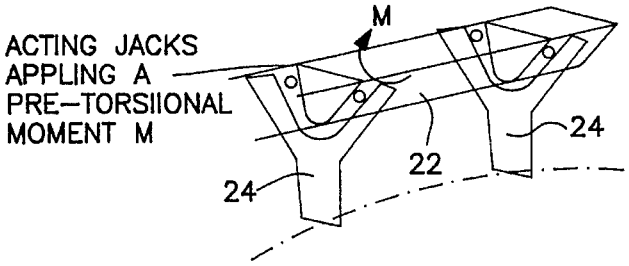
FIG. 23 is a perspective schematic illustration of the forces to be applied in the vehicle by jacks inserted between the pier arms and the vehicle that introduce a pre-torsion that balances the torsions of the curved span.

The preferred embodiment as shown in FIG. 20 has a support assembly including a base 76 which falls into a socket or recess in the pier. The support assembly includes a pair of jacks 78 and 80 with a support member 82 on top thereof having rollers 84 for engaging the bottom surface 54 for supporting the vehicle for movement between piers. Upper blocking jacks 86 and 90 and lower blocking and positioning jacks 88 and 92 support the vehicle at each pier. These enable the vehicle to be centered and to tilt as in FIG. 23 to accommodate a curved section of viaducts.

The piers are each provided with sphere guide bearing sockets 94 and 96 to receive corresponding spherical bearings of a girder.

The vehicle is constructed with post-tension cables as shown at 98 and 100 in FIG. 17 and FIG. 20 to pre-tension the vehicle. Such cable tensioning is taught generally in U.S. Pat. No. 3,909,863, which is incorporated herein as though fully set forth.

Figure 28:
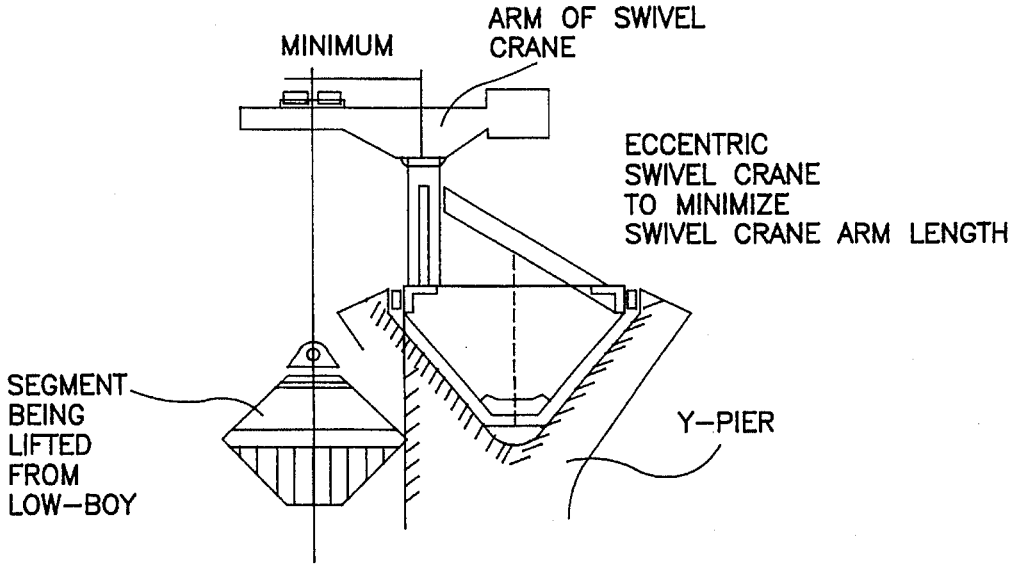
FIG. 28 is an end elevation view illustrating the eccentric position of the swivel crane to reduce to a minimum its rotating arm.
Figure 29:
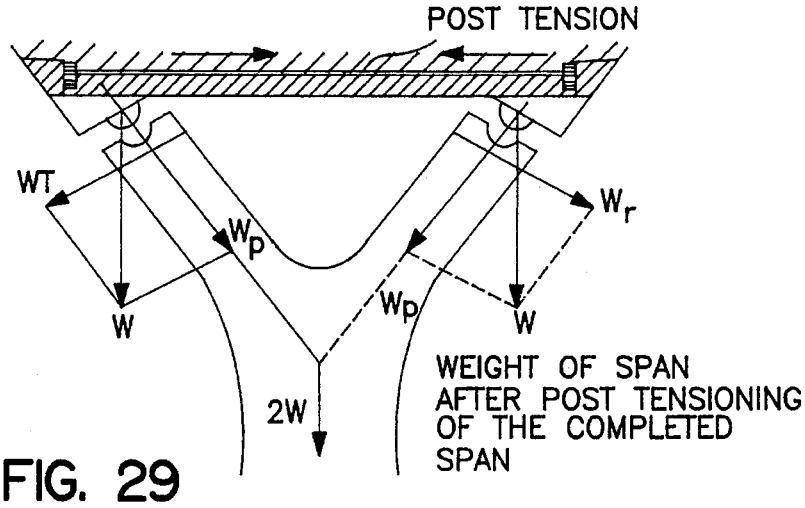
FIGS. 29, 30, 31, 32 are like end views illustrating the system pier-deck-bearings that enables the use the pier segment as the tie of the two arms of the "Y" shaped pier.
Figure 30:
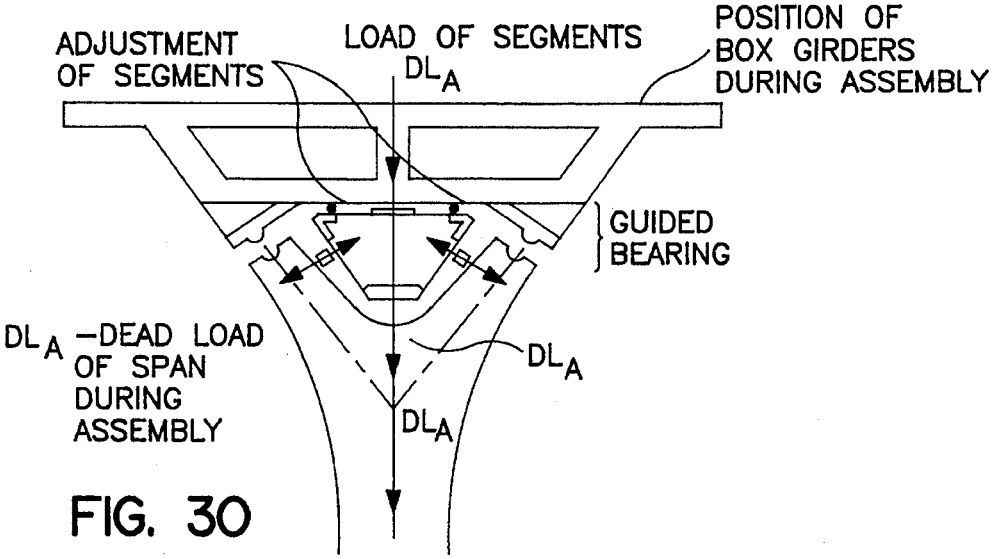
Figure 31:
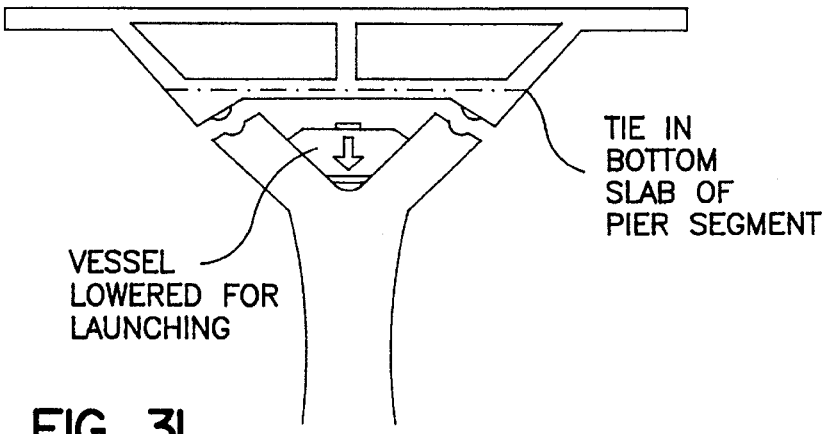
Figure 32:
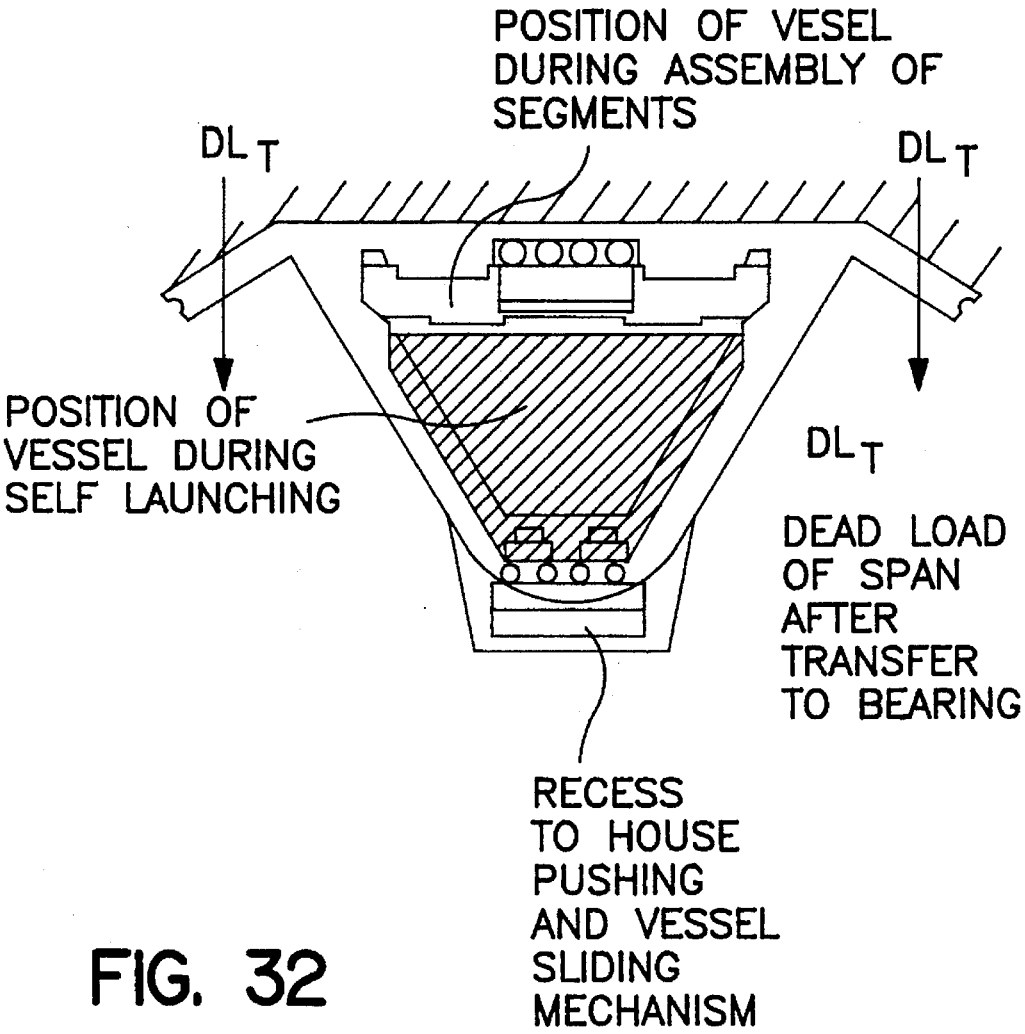

The most novel aspect of the system is the integration of the erection equipment with the assembly vehicle, thus allowing the two operations erection and assembly to be done by the same unit which then can move, along the complete viaduct alignment, together. The appropriate erection equipment for the system is a swivel crane that is basically composed of a pylon rigidly fixed in the nose of the vehicle and by a rotating arm that is equipped with a movable winch. This swivel crane takes the precast segments at ground level, directly from the low-boys or trucks, lift, turn and place the segments in sequential order over the top of the sliding tracks of the vehicle. During the time the segment is pushed to its final position in the span, the swivel crane can already be lifting the next segment. The swivel crane may also be used as a pulling device to pull the vehicle to the next span. Other uses of the crane are the lifting of post-tension cables. By placing the swivel crane just in front of the front pier of the span being assembled, it can pick up and place heavy segments with an arm of the reduced length and with relatively light torsional moments. The swivel crane can also be fixed eccentrically in relation to the center line of the vehicle reducing considerably the length of its rotating arm. {FIG. 28}

An additional advantage that gives the swivel crane installed on the front of the vehicle, is that the transport of segments does not need to be done over the viaduct being built. This improves the safety of the overall system, allows the already built viaduct to be completely finished immediately behind the assembly of the spans. This allows to open to traffic partial sections of the viaduct without interference with the construction operations.

Figure 24:
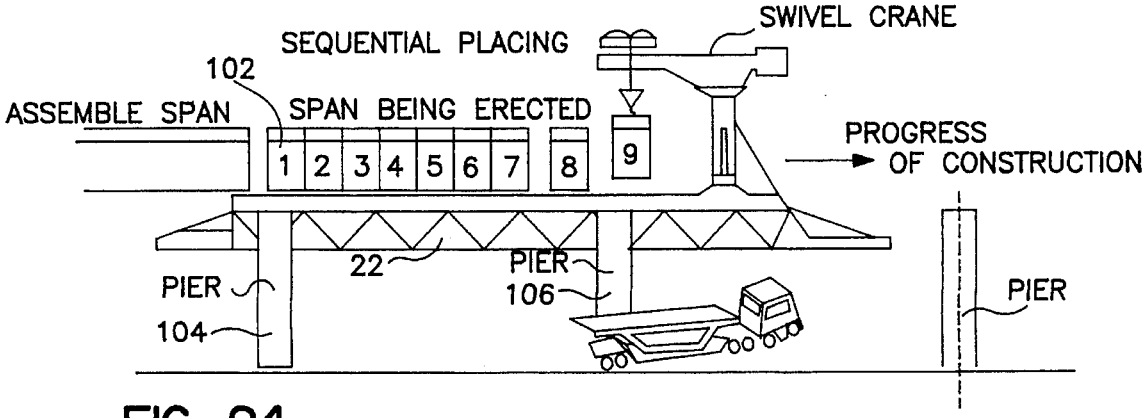
FIG. 24 is a side elevation view of the sequence of erection of a typical span according to the invention.
Figure 25:
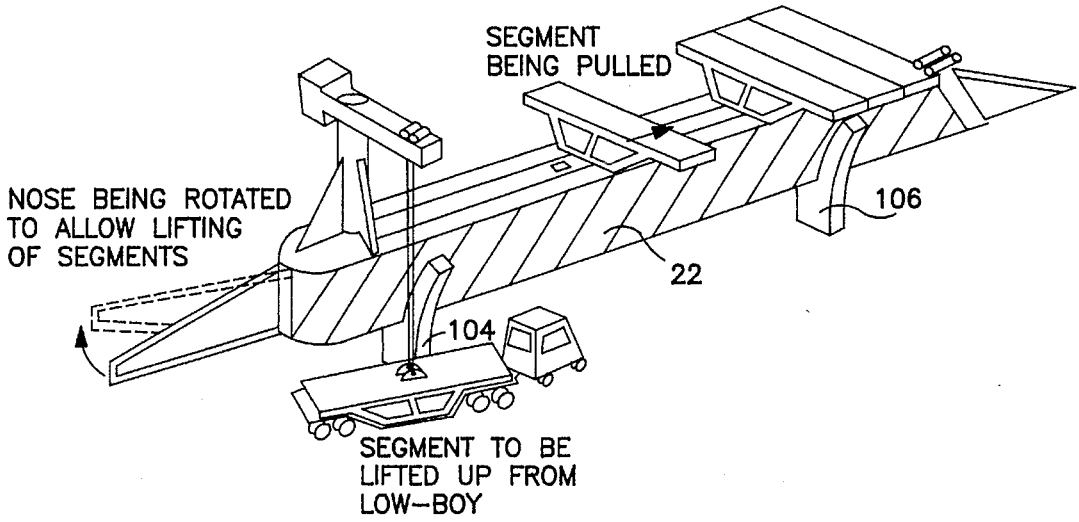
FIG. 25 is a perspective of the FIG. 24 sequence of erection.

Referring to FIGS. 24 and 25, the assembly of a plurality of girders 102 between a pair of piers 104 and 106 is illustrated. The girders are lifted by the crane from a truck at ground level and placed on the assembly vehicle where they are moved together.

Figure 26A:
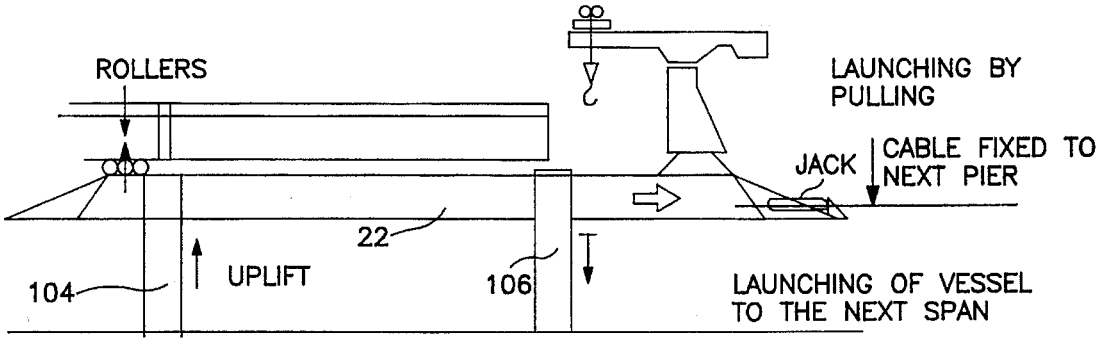
FIG. 26 a and b is a side elevation view of the sequences of self-launching of the vehicle from one span to the next span.
Figure 26B:
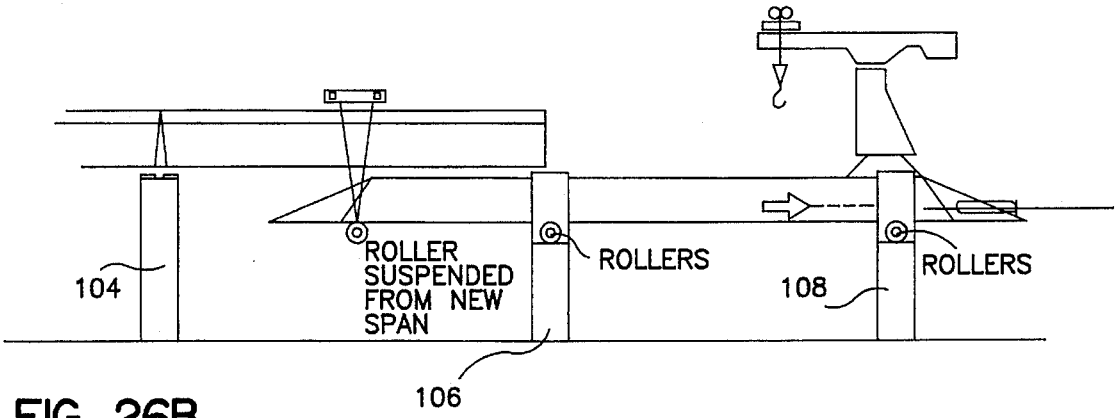
Figure 27:
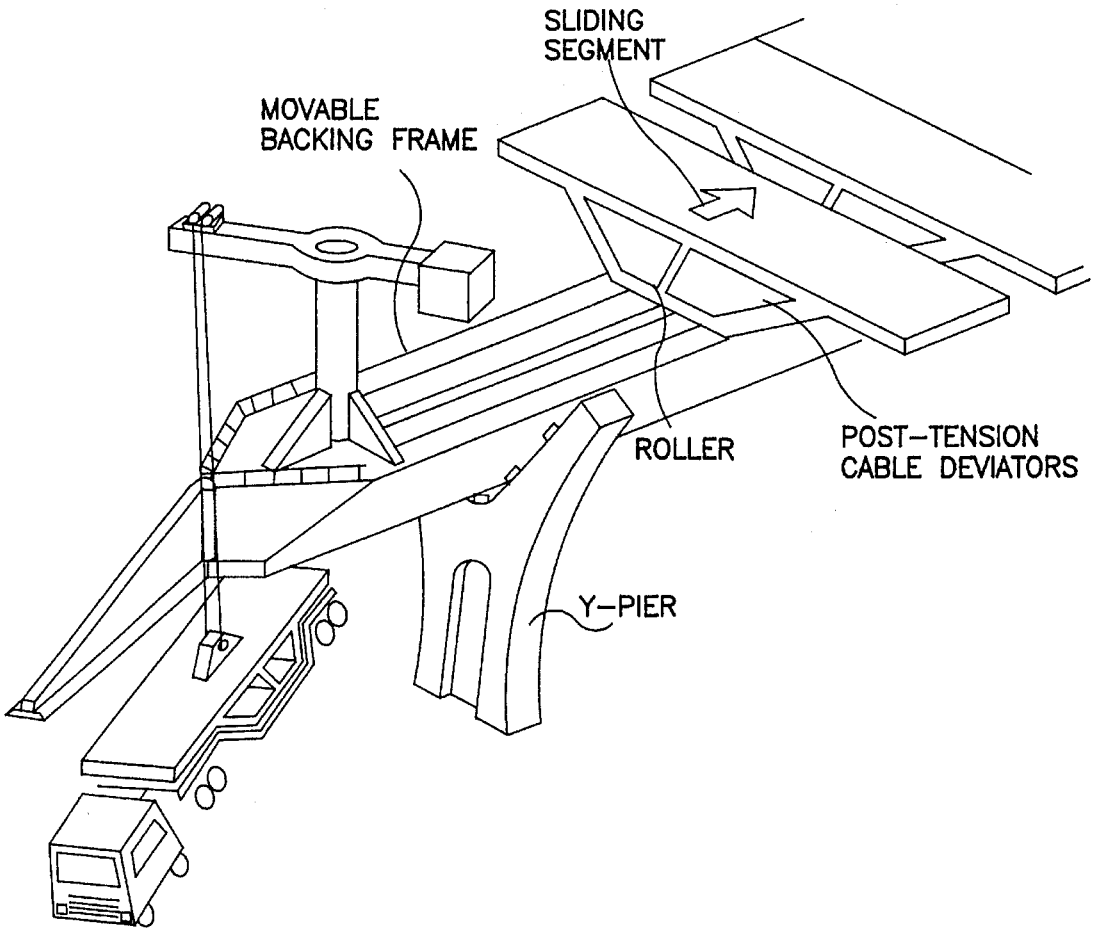
FIG. 27 is a detailed perspective of the erection section of the vehicle.

The assembly continues until the two piers are spanned as shown in FIG. 26*a*. The assembly vehicle is then advanced to the next pier 108 as shown in FIG. 26*b*. The vehicle is the properly secured in place and aligned. The assembly of girder sections then continues.

Figure 33:
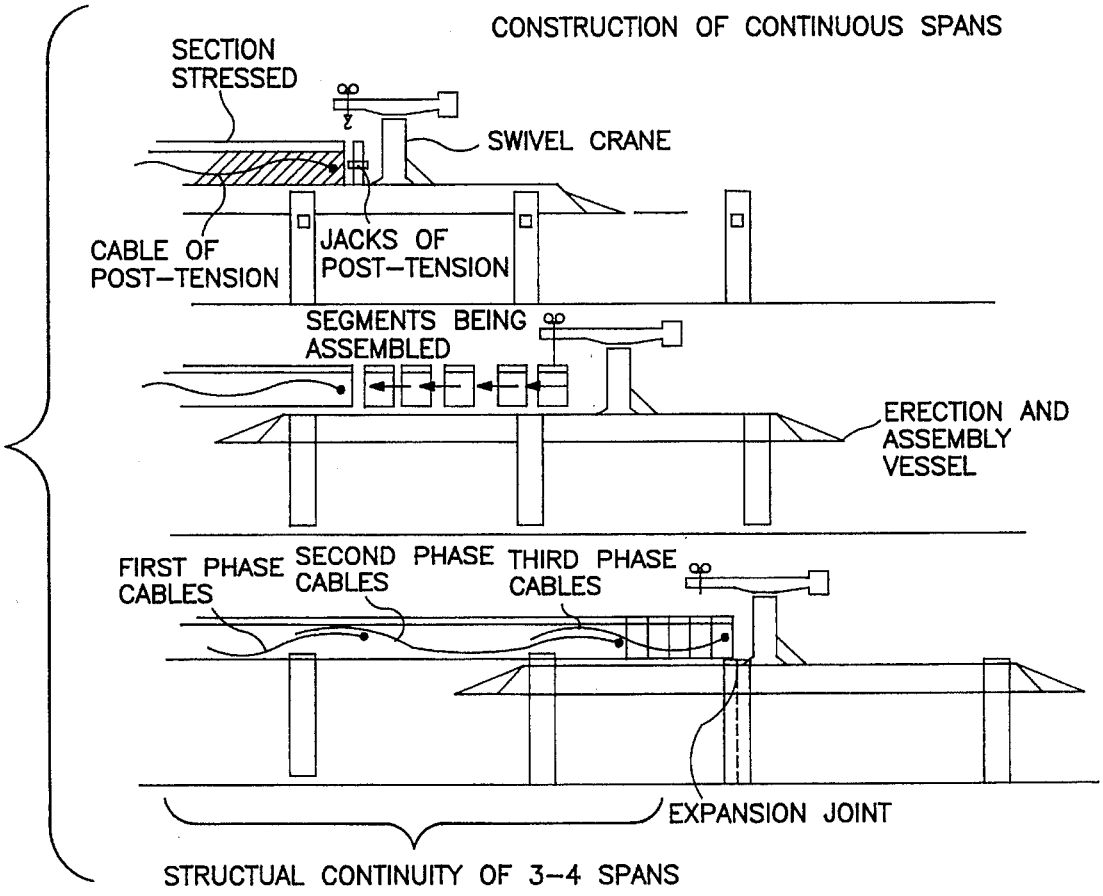
FIGS. 33 is a side elevation view of the use of the invention in continuous spans with progressive erection and assembly.

The continuous construction of a span is illustrated in FIG. 33 with first, second and third post-tension cables shown.

Referring to FIGS. 29–32, the supporting of viaduct sections on the vehicle for assembly is illustrated with assembled units lowered onto piers into guide bearings.

When "Y" piers cannot be provided, for instance, if the viaduct is at a lower level, the vertical piers are commonly used. In this case, the swivel crane can still be used, fixed between the two parallel trusses or steel box girders of the prior art, and bring a considerable improvement to this prior art by speeding up the erection cycle and reducing the traffic interface of the cranes working at ground level. Another very specific feature of the invention is the system composed by the precast segmental deck and the "Y" piers. The transfer of loads from the vehicle to the bearings does not require a tie connecting the arms of the "Y" pier. The same effect is obtained by using the bottom slab of the pier segment as a tie by the introduction of special spherical guided bearings placed perpendicular to the arms of the piers. The pier segment bottom slab is transversely post-tensioned to resist the tension forces of the pier arms.

The invention covers also the extension of the construction system to continuous structures. In effect, contrary to the span-by-span construction method that is specifically used in simple supported structures, the present invention allows, without any difficulty, the construction of the continuous structures over 3, 4 or more spans. The continuity of structures allow the increase in span lengths and for a given span length, offers savings in materials, in particular, post-tension and labor, and has a better structural behavior.

The use of the construction system in continuous structures can be appreciated in FIG. 33. The method may require few changes in the length of the vehicle and the hydraulic systems. Accordingly, a novel precast segmental viaduct construction system has been disclosed. Although preferred embodiments have been shown and described, it will be appreciated by persons skilled in the art that many modifications could be made thereto in view of the teachings herein. The invention, therefore, is not limited except in accordance with the spirit of the following claims and equivalents thereof.

I claim:

1. A precast segmental viaduct construction system, comprising:

an elongated erection and assembly vehicle for spanning between at least two viaduct piers and for moving between successive piers, said vehicle having a top deck, an elongated central longitudinal beam having a down facing elongated planar bottom support surface, a pair of elongated trusses secured to and inclined outward from said beam, and a pair of elongated longitudinal planar top support surfaces extending along opposite side edges of said top deck;

a plurality of jacks spaced along said vehicle for cooperatively engaging piers on which said vehicle is supported for positioning said vehicle relative to piers on which it is supported; and a support assembly for supporting said vehicle on a pier, said support assembly having jacks for selectively elevating and lowering the vehicle.

2. A construction system according to claim 1 wherein said support assembly for supporting said vehicle on a pier includes rollers for movably supporting the vehicle.

3. A construction system according to claim 2 wherein said vehicle includes an elongated nose section at a front end of said vehicle, said nose section hinged for pivoting about a vertical axis, and an elongated tail section at a tail end of said vehicle hinged for pivoting about a vertical axis.

4. A construction system according to claim 3 wherein said central beam is an I beam defining said bottom support surface and a top support surface.

5. A construction system according to claim 1 wherein said central beam is an I beam defining said bottom support surface and a top support surface.

6. A construction system according to claim 1 wherein:

said vehicle has a generally triangular transverse cross section and is adapted to mount between the vertical legs of Y shaped piers; and said plurality of jacks spaced along said vehicle cooperatively engage said legs of said piers.

7. A construction system according to claim 6 wherein said central beam is an I beam defining said bottom support surface and a top support surface.

8. A construction system according to claim 7 wherein said vehicle further comprises a swivel crane mounted on said top deck of said vehicle for lifting and positioning viaduct sections.

9. A construction system according to claim 1 wherein said vehicle further comprises a swivel crane mounted on said top deck of said vehicle for lifting and positioning viaduct sections.

10. A construction system according to claim 9 wherein said swivel crane is mounted on a forward end of said top deck of said vehicle.

11. A construction system according to claim 9 wherein said swivel crane is mounted on a side edge of said top deck of said vehicle.

12. The construction system of claim 1 wherein the vehicle further comprises longitudinally post-tensioned external unbonded cables for selectively introducing one of a pre-camber and a pre-torsion in the vehicle before erection of a selected one of a large span and a curved span respectively.

13. The construction system of claim 1 further comprising:

a first viaduct pier to support the rear end of a span to be constructed, said viaduct pier having a "Y" shape;

a second viaduct pier to support a front end of a span to be constructed, said viaduct pier having a "Y" shape;

first and second vehicle support assembly mounted on said respective first and second piers for supporting the vehicle;

said vehicle has a generally triangular transverse cross section and is mounted on said support assemblies on said first and second piers between the vertical legs of said Y shaped piers, said plurality of jacks spaced along said vehicle cooperatively engaging said legs of said piers and said vehicle further comprises longitudinally post-tensioned external unbonded cables for selectively introducing one of a pre-camber and a pre-torsion in the vehicle before erection of a selected one of a large span and a curved span respectively; and a swivel crane mounted on said top deck of said vehicle for lifting and positioning viaduct sections.

14. Method for constructing a precast segmental viaduct comprising the steps of:

constructing a first viaduct pier to support the rear end of a span to be constructed, said viaduct pier having a "Y" shape;

constructing a second viaduct pier to support a front end of a span to be constructed, said viaduct pier having a "Y" shape;

mounting first and second vehicle support means on said respective first and second piers for supporting an erection and assembly vehicle;

providing an elongated erection and assembly vehicle for spanning between at least two viaduct piers and for moving between successive piers, said vehicle having a top deck, an elongated central longitudinal beam having a down facing elongated planar bottom support surface, a pair of elongated trusses secured to and inclined outward from said beam, and a pair of elongated longitudinal planar top support surfaces extending along opposite side edges of said top deck positioning the longitudinal erection and assembly vehicle that passes through said first and second piers, with vertical and horizontal jacks integrated in the vehicle and in its supports;

mounting said vehicle between said first and second piers;

blocking the vehicle against the arms of the said first and second pier; adjusting, if required, the camber and the torsional rigidity with internal post-tensioning;

using the swivel crane fixed over the nose of the vehicle to lift up, rotate and place, sequentially, the segments of the span being assembled;

once the segments are released by the swivel crane, each segment is pushed or pulled to its final position in the span, levelled and adjusted against the previous segment;

after assembling all segments of one span, the post-tensioning cables are placed and stressed and the span becomes self-supported;

the vehicle is then lowered and pushed or pulled to the next span, with the nose and the tail assuring the stability of the vehicle that remains always supported by 2 piers.

15. The method of claim 14 wherein said vehicle is equipped with post-tensioning stressing jack platforms that can be handled by the swivel crane.

16. The method of claim 14 wherein said vehicle can assemble sections of the bridge deck that are not interrupted at each pier, thus establishing continuous structures with continuous post-tensioning cable layouts.

17. The method of claim 14 wherein said "Y" shaped piers and the pier segment are constructed to take the thrust that creates at the top of the arms by placing spherical guided bearings perpendicular to the axis of the arms and post-tensioning the bottom of the pier segment appropriately shaped.

* * * * *